United States Patent [19]

Harding

[11] Patent Number: 5,072,346

[45] Date of Patent: Dec. 10, 1991

[54] LIGHT BEAM AMPLIFIER

[76] Inventor: David K. Harding, 88 Tilt St., Haledon, N.J. 07508

[21] Appl. No.: 474,219

[22] Filed: Feb. 2, 1990

Related U.S. Application Data

[62] Division of Ser. No. 265,940, Nov. 2, 1988, Pat. No. 4,920,469.

[51] Int. Cl.[5] ..... F21L 15/02

[52] U.S. Cl. ..... 362/187; 362/298

[58] Field of Search ..... 362/61, 298, 300, 301, 362/302, 346, 187, 202

[56] References Cited

U.S. PATENT DOCUMENTS

| | | | |
|---|---|---|---|
| 1,219,583 | 3/1917 | Perry | 362/300 |
| 1,575,327 | 3/1926 | Garford et al. | 362/61 |
| 1,675,877 | 7/1928 | Burdt | 362/61 |
| 1,950,918 | 3/1934 | Forbes | 362/61 |
| 2,120,836 | 6/1938 | Grimes | 362/302 |
| 2,277,981 | 3/1942 | Horton | 362/61 |
| 4,458,303 | 7/1984 | Berns | 362/298 |
| 4,755,916 | 7/1988 | Collins | 362/298 |
| 4,855,885 | 8/1989 | MacEachern et al. | 362/302 |

FOREIGN PATENT DOCUMENTS

| | | | |
|---|---|---|---|
| 1179022 | 10/1964 | Fed. Rep. of Germany | 362/301 |
| 119470 | 10/1919 | United Kingdom | 362/302 |
| 199049 | 6/1923 | United Kingdom | 362/300 |

*Primary Examiner*—Ira S. Lazarus
*Assistant Examiner*—Richard R. Cole
*Attorney, Agent, or Firm*—Edward M. Livingston

[57] ABSTRACT

A light-condensing reflector positioned at the opposite side or end of a light source from a primary paraboloidal reflector in opposed reflector-to-reflector relationship to amplify light. The light-condensing reflector is selectively smaller in diameter than the primary reflector such that an annular or ring-like light orifice is formed between the outside periphery of a base of the light-condensing reflector and the inside periphery of a base of the primary reflector. Light amplified and condensed by the two opposed reflectors is collimated in an annular light beam through the annular light orifice. When applied to flashlights, spotlights and vehicle headlights, this invention increases the light intensity substantially.

2 Claims, 1 Drawing Sheet

FIG 1
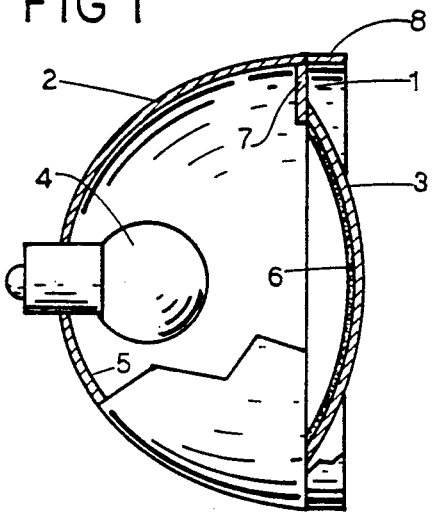
FIG 2
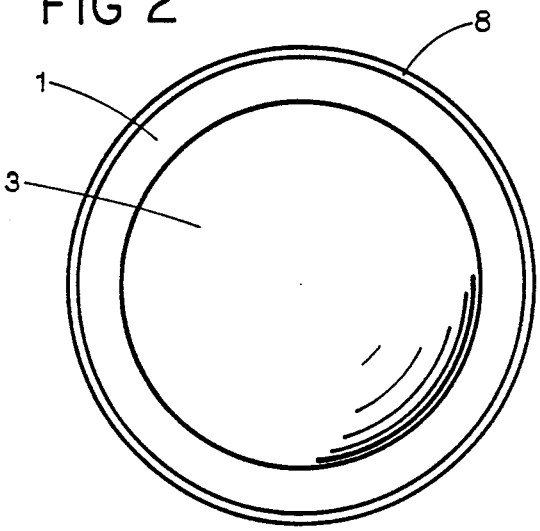
FIG 3
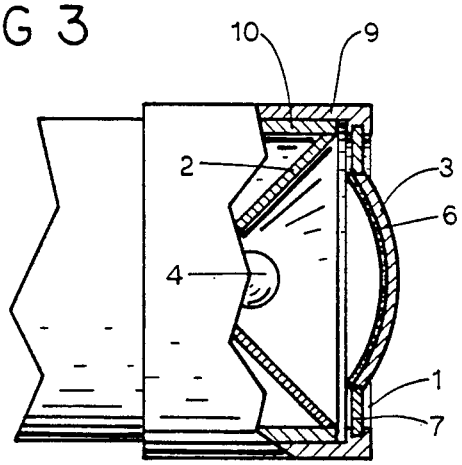
FIG 4
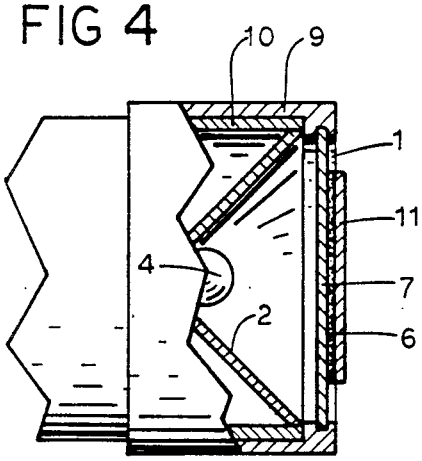
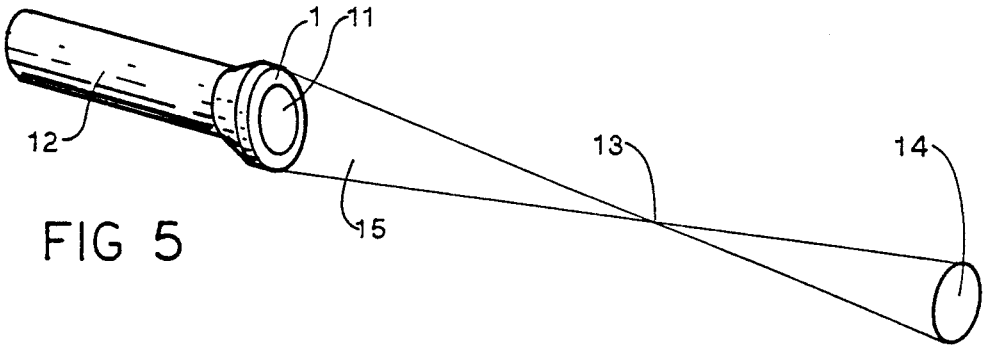
FIG 5

LIGHT BEAM AMPLIFIER

This is a division of application Ser. No. 07/265,940, filed on Nov. 2, 1988, now U.S. Pat. No. 4,920,469.

BACKGROUND OF THE INVENTION

This invention relates to lenses and reflectors for electric lights such as flashlights, spotlights, vehicle driving lights, fog lights and lighthouse lights. In particular, it relates to a method of concentrating and collimating light for long-distance illumination with minimized peripheral emission and glare. More particularly, it is a method of amplifying and condensing light into an annular ring by employing a principle similar to collimation of light in lasers.

Methods for directing light for long-distance illumination have included various forms of paraboloidal reflectors at one side or end of a light source and magnifying, shielding and peripheral filters for directing light beams from the opposite side or end of the light source. Notable have been U.S. Pat. No. 4,701,834 which teaches a paraboloidal configuration of a reflector with uniquely zoned sections for accomplishing reflection in desired directions while inhibiting reflection in undesired directions of illumination. This method does not concentrate or fully collimate all light in a desired direction. U.S. Pat. No. 4,731,713 teaches a separate parabolic reflector characteristic for upward reflection than for downward reflection of light. This method also leaves a great portion of the light quantum uncollimated into a single beam direction. U.S. Pat. No. 4,209,825 granted to Shackelford taught restriction of light to an elliptical form with an annular elliptical light orifice between covered inside and outside portions of a lens. The Shackelford patent employed an opaque and optionally black center that could have been made to function as backing for a reverse reflecting light condenser if the effects had not been almost totally nullified by the outside opaque ring. The outside opaque ring inhibits condensed light precisely where it is most effective.

Some earlier prior art applied what could have been minor steps towards laser reflection, but apparently without sufficient understanding of the principle to employ it effectively. Included were U.S. Pat. Nos. 2,305,818, 2,199,014 and 2,147,543. These patents taught covering of an incandescent light at the center of a parabolic reflector with a light inhibitor with the intended effect of limiting direct glare from the light source independently. In these patents, glare was treated as a disadvantageous factor and eliminated rather than directed for greater effectiveness as taught by the instant invention. There were reverse reflectors but they were employed in methods that tended to decrease rather than to increase concentration of light in an annular ring. Reflection of all light to an outside ring of condensed light was not taught nor employed in the prior art.

SUMMARY OF THE INVENTION

One object of this invention is to provide long-distance of illumination in proportion to light quantum of candle power.

Another object of this invention is to direct light towards a relatively small area.

Another object of this invention is to provide directed light beam with minimized peripheral lighting effect.

Another object of this invention is to provide increased efficiency of light projection in order to minimize electrical power required for long-range projection.

Another object of this invention is to provide maximized concentration of a light beam for penetrating reflective gases such as fog for driving lights.

Another object of this invention is to provide long-distance light beams for high-speed driving and aircraft landing-light conditions.

Another object of this invention is to provide a lens covering that can be attached conveniently to existing flashlights, spotlights and driving lights to convert them to more effective long-distance lights.

The instant invention accomplishes the above and other objects by providing a light-condensing reflector which is positioned at the opposite side or end of a light source from a primary paraboloidal or generally conical reflector in opposed reflector-to-reflector relationship. The light-condensing reflector is selectively smaller in diameter than the primary reflector such that an annular light orifice is formed between the outside periphery of a base of the light-condensing reflector and the inside periphery of a base of the primary reflector. Light amplified and condensed by the two opposed reflectors is collimated in an annular light beam through the annular light orifice. Principles of light concentration and collimation similar to those employed for generating laser light beams are employed for effective long-range driving lights, spotlights and flashlights in this invention.

The novel features which are considered as characteristic for the invention are set forth in particular in the appended claims. The invention, however, both as to its construction and its method of operation, together with additional objects and advantages thereof, will be best understood from the following description of specific embodiments when read in connection with the accompanying drawings and the claims.

BRIEF DESCRIPTION OF THE DRAWINGS

FIG. 1 is a cutaway side view of a vehicle driving light embodiment of the invention;

FIG. 2 is a front view of the embodiment of the invention in FIG. 1;

FIG. 3 is a cutaway side view of the invention with an adjustable light condenser;

FIG. 4 is a cutaway side view of the invention with light condenser attached to a typical flashlight;

FIG. 5 is a perspective view of the invention in use on a typical flashlight.

DESCRIPTION OF PREFERRED EMBODIMENTS

Referring to FIGS. 1 and 2, a light orifice 1 is formed between the inside periphery of a base of a paraboloidal or generally conical primary light reflector 2 and the outside periphery of a base of a light-concentration reflector 3. Light from a light source 4 is reflected onto inside primary reflector surface 5 towards light-concentration reflector surface 6.

Between the two reflective members 2 and 3, light and heat from the light source is contained, amplified and directed out from between them through the annular light orifice 1. The annular light orifice is illustrated here as a lens 7. It may be open, however. All light generated is reflected and collimated in an annular beam. The base of the primary light reflector 2 can be provided with light deflector sleeve 8 which is extended selectively out over and beyond the light-concentration reflector 3.

The primary reflector 2 and the light-concentration reflector 3 can be constructed in various shapes for particular use conditions. For optimizing laser concentration and collimation of light, the two reflectors would be designed in relationship to each other. Both could have a generally paraboloidal form. However, the light-concentration reflectors 3 would have a generally flatter construction. The light-concentration reflector 3 may consume over 80 percent of the total plane surface and the light orifice 1 may consume less than 20 percent for most long-distance illumination. For some low-cost applications, such as an attachment to the lens of an ordinary flashlight, the light-concentration reflector 3 could be smaller in diameter and could be optionally either paraboloidal, conical or flat.

As illustrated and discussed hereinbelow in regard to FIG. 2, the light beam converges at some point of distance from the front of the annular orifice, depending on the size of the orifice and the contour of both reflective surfaces.

Concentrating and amplifying both heat and light between the two reflectors is significant to the object of this invention in relation to conservation of energy. It maximizes energy efficiency and thereby minimizes utilization of electricity in proportion to effective long-distance light amplification. This is because heat generates light and less heat lost results in less electrical energy for generating light.

Referring to FIG. 3, an adjustment sleeve 9 is illustrated in linearly moveable relationship to housing 10 to which light source 4 and primary light reflector 2 are attached. Movement of the light-concentration reflector 3 closer towards or farther away from the light source 4 adjusts the level of concentration and, consequently, the level of diffusion or concentration of light as desired.

Referring to FIG. 4, a flat light-concentration reflector 11 is shown in a similar relationship to the adjustment sleeve 9, the housing 10 and the light source 4 as for FIG. 3. This is a low-cost form of the invention that can be attached to existing flashlight lenses. Distance adjustment could be provided by threaded relationship between the adjustment sleeve 9 and the housing 10.

Referring to FIG. 5, a perspective view of a flashlight housing 12 is shown emitting a light from the light orifice 1 to a point of convergence 13 and to a distance light terminus 14. A conical section 15 of the light beam is relatively low in light concentration. Preferably the back of the light-concentration reflector 3 in al parabolic or flat forms is black.

As described in detail above, it should be apparent that there has been provided a new, useful and nonobvious device and method for the amplification of light generated by flashlights, vehicle headlights and other electrical lights which offers numerous advantages. Among the advantages is increased efficiency of such lights and maximized distance of light projection.

Whereas this invention has been described in particular relation to the drawings attached hereto, other and further modifications apart from those shown or suggested herein may be made within the scope of the invention as described in the following claims.

What is claimed is:

1. A light beam amplifier comprising:

a light source;

a generally conical primary reflector having a vertex at the light source and an opening at a base at the opposite side of the light source;

a light-concentration reflector having a diameter selectively smaller than the primary reflector at the opposite side of the base from the light source and positioned to reflect light and heat back toward the primary reflector and the light source;

an annular light emission orifice adjacent to and extending between the outside periphery of the light-concentration reflector and the inside periphery of the primary light reflector; and a means for adjusting the distance of the light-concentration reflector from the primary reflector.

2. A light beam amplifier according to claim 1 wherein the means for adjusting the distance of the light-concentration reflector from the primary reflector is a threading relationship between a housing for the primary reflector and a sleeve member to which the light-concentration reflector is attachable.

* * * * *